US006775939B1

(12) United States Patent
Juern

(10) Patent No.: US 6,775,939 B1
(45) Date of Patent: Aug. 17, 2004

(54) DISPLAY FRAME COMBINATION ENABLING ROTATION THEREOF WHILE MOUNTED ON A WALL

(76) Inventor: Jeremy Scott Juern, 2631 University Ave. #3, Madison, WI (US) 53705

( * ) Notice: Subject to any disclaimer, the term of this patent is extended or adjusted under 35 U.S.C. 154(b) by 69 days.

(21) Appl. No.: 10/235,901

(22) Filed: Sep. 5, 2002

(51) Int. Cl.[7] ..... A47G 1/16
(52) U.S. Cl. ..... 40/757; 40/734; 248/489
(58) Field of Search ..... 40/613, 734, 741, 40/757, 759, 793, 795; 248/489

(56) References Cited

U.S. PATENT DOCUMENTS

| | | | | |
|---|---|---|---|---|
| 299,155 | A | 5/1884 | McGill | |
| 300,100 | A | 12/1884 | McGill | |
| 663,737 | A | * 12/1900 | Doble | 248/495 |
| 779,366 | A | * 1/1905 | Kelsea | 40/757 |
| 969,195 | A | * 9/1910 | Rothstein | 248/493 |
| 1,308,695 | A | * 7/1919 | Bushkovski | 40/741 |
| 1,358,534 | A | 11/1920 | Finch | |
| 1,407,177 | A | * 2/1922 | Stone | 40/757 |
| 1,914,951 | A | 12/1933 | Kiessling | |
| 1,982,143 | A | * 11/1934 | Schill | 40/784 |
| 3,030,718 | A | * 4/1962 | Kirkman | 40/617 |
| 3,783,543 | A | 1/1974 | Hemgren | |
| 3,946,512 | A | * 3/1976 | Shapiro | 40/759 |
| 4,630,386 | A | 12/1986 | Wilson | |
| 4,947,565 | A | 8/1990 | Shadwell | |
| 5,099,589 | A | 3/1992 | Lai | |
| 5,100,094 | A | * 3/1992 | Handwerger et al. | 248/489 |
| 5,167,085 | A | 12/1992 | Yang | |
| 5,243,777 | A | 9/1993 | Dedlow | |
| 5,283,967 | A | 2/1994 | Abrams | |
| D347,859 | S | 6/1994 | Glynn | |
| 5,377,434 | A | 1/1995 | Wilson | |
| 5,494,396 | A | 2/1996 | Geier et al. | |
| 5,529,173 | A | 6/1996 | Salacuse | |
| D396,350 | S | 7/1998 | Panzenhagen | |
| 6,119,999 | A | * 9/2000 | Fleishman | 248/489 |
| 6,230,428 | B1 | * 5/2001 | Albin | 40/730 |

FOREIGN PATENT DOCUMENTS

| | | |
|---|---|---|
| JP | 02000116480 A | 4/2000 |

* cited by examiner

*Primary Examiner*—S. Joseph Morano
*Assistant Examiner*—Lars A. Olson
(74) *Attorney, Agent, or Firm*—Patricia Smith King

(57) ABSTRACT

A reversible display frame combination that may be pivotably mounted on a wall so as to enable its rotation while mounted to enable a user to selectively show the display item(s) contained therein from either side without a change in appearance of the combination, and method for employing same is disclosed. The display frame combination comprises a reversible display frame and a suspension device. The reversible display frame comprises generally a frame member and one or more suspension rings attached to the frame member. In one version, the suspension rings are retractable. The suspension device enables rotation at a wall assembly by means of a pivotally coupled upper and lower loop member.

2 Claims, 6 Drawing Sheets

10
32
40

FIG. 5a
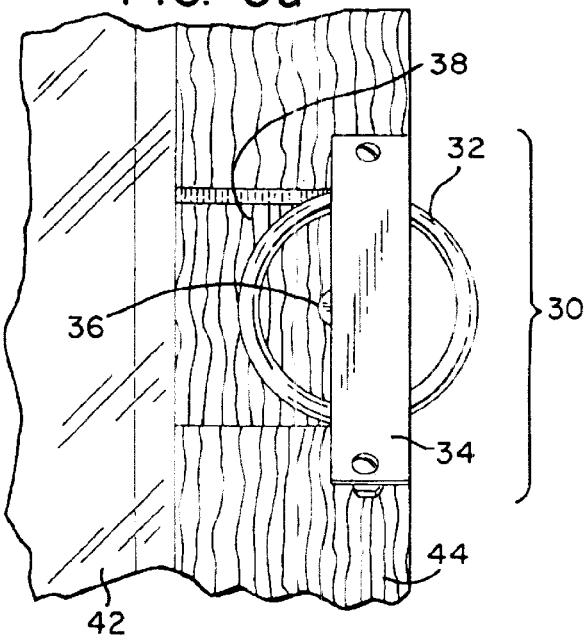
FIG. 5b
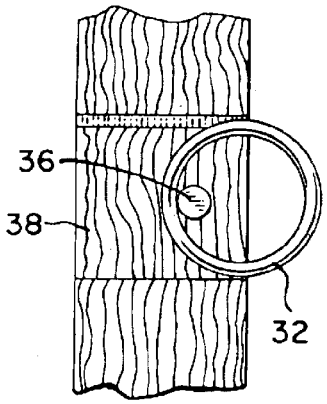
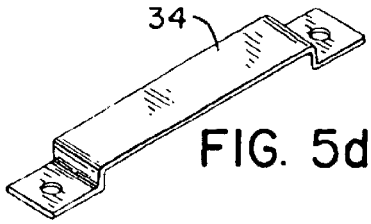
FIG. 5d
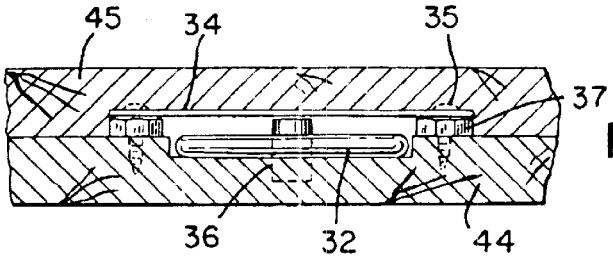
FIG. 5c
FIG. 5e
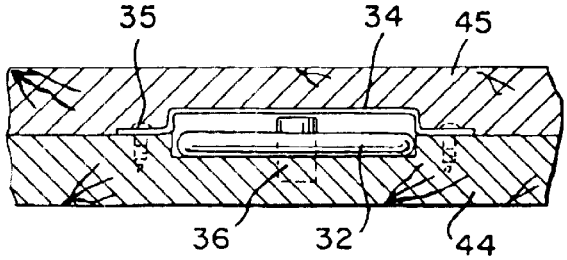

DISPLAY FRAME COMBINATION ENABLING ROTATION THEREOF WHILE MOUNTED ON A WALL

CROSS-REFERENCE

Application requests that Disclosure Document no. 512097, filed at U.S. Patent and Trademark Office on May 28, 2002 be associated with this application and be incorporated herein by reference.

STATEMENT REGARDING FEDERALLY SPONSORED RESEARCH OR DEVELOPMENT

Not applicable.

BACKGROUND

Reversible display frames are convenient means by which to enable users to view two different items contained in the frames. One item may be viewed from one side of the frame, another item (or other side of the same item) may be viewed from the other side of the frame. This is a feature convenient for locations where the items on display may require change often or for users who simply desire to change the items on display from time to time without the need to replace the entire frame. A reversible display frame serves to display two, rather than just one item as with other display frames. Many collectors of items with two-sided artwork, such as posters from National Geographic and the like, require a reversible frame to display both sides of the posters.

Many reversible display frames exist. However, few enable easy reversal. For example, some reversible frames are mounted in the general fashion of many non-reversible frames. That is, they have a loop or other type of frame hanger attached to the frame for suspension of the frame from a wall hook. In that case, a user must remove the frame from the hook, flip it over and re-hang it by a frame hanger located on its opposite side. Not only must the user completely remove the frame from the wall to reverse it, but a frame hanger must be attached to both sides of the frame resulting in one hanger always being visible from the display side. The visibility of a frame hanger on the displayed side of the reversible frame mars the look of the frame and detracts from the view of the display items therein.

One approach to provide easy reversal of frames is to enable their reversal while still mounted on a wall. An advantage of being able to reverse a frame while still suspended from a wall hook or the like, is that most of the weight of the frame is supported by the wall hook. Thus a user is able to reverse the frame without exerting as much strength as would be required to completely remove the frame from the wall, reverse it and then reinsert it on a wall hook.

Prior attempts to provide a mechanism to reverse a frame while mounted on a wall are inadequate to the task because, though they may enable reversal of a frame while mounted on a wall, they do not do so well. Typically they do not provide reversible display frames in combination with suspension devices that are sufficiently attractive to display finer art or other types of display items, and that are not marred in appearance by the suspension devices employed.

For example, some reversible display frames are hung by a suspension line attached at two points on one edge of the frame by means of suspension loops, tacks or the like, the line being positioned on a wall hook for mounting on a wall or other surface. This approach is commonly seen applied to window signs indicating whether a shop is open or closed for business. The approach enables a user to simply rotate the frame while it is mounted to view the display items visible on the opposite side. The problem with this approach is that the line becomes twisted when the display frame is rotated and this mars the appearance of the frame and the display items therein. Also, the suspension loops are generally attached to only one side for display in one orientation only. When attached to two sides to enable display in either the vertical or horizontal orientation, the loops not in use (i.e. the loops on the vertical or horizontal side of the frame) remain visible. This creates an unattractive appearance to the frame.

Yet another approach to the problem is disclosed in U.S. Pat. No. 5,099,589 to Lai. In this approach, a reversible display frame is specially formed so that one edge of the frame fits into a wall member designed to suspend the frame from a wall. The display frame may be slid on and off the wall hanger to enable a user to flip the display frame over for viewing display items from the other side. The problem with this approach is that it requires a user to completely remove the frame from the hanger. It also requires the use of a frame with an edge specially modified for insertion on the wall hanger. Only one orientation of display is possible with this approach.

For the foregoing reasons, there is a need for a suspension device for a reversible display frame that enables a user to reverse the frame while it is mounted on a wall, that will maintain its appearance no matter how it is rotated and that may be used with most reversible display frames with minimal modification. It is still further a need for a reversible display frame enabling orientation of enclosed display items either vertically or horizontally by means of attachment to a suspension device (such as loops, hooks, etc.) that are visible only when in use.

SUMMARY

The present invention is directed to a display frame combination that satisfies this need. The display frame combination having features of the present invention comprises a reversible display frame with a frame member and a suspension device. The frame member has a front side and a back side, the front and back sides each having a window section for viewing a display item contained therein from either side of the frame member and, one or more suspension rings attached to the frame member. The suspension device enables rotatable mounting of the reversible display frame to a wall. It has a wall assembly with an upper loop member and a lower loop member pivotally coupled one to the other, the upper loop member being sized to enable insertion on a wall hook. It also has one or more fasteners for engagable attachment of the suspension device to the suspension rings of the reversible display frame and one or more lines each having an upper end and a lower end, the upper end being connected to the lower loop member of the wall assembly, the lower end being connected to a fastener. In this way, the reversible display frame combination may be pivotably mounted on the wall so as to enable its rotation while mounted to enable a user to selectively show the display item(s) contained therein from either side of the reversible display frame without marring the appearance of either the frame or the suspension device.

In another version, the display frame combination further comprises one or more suspension ring assemblies to enable the suspension rings to be retracted when not in use and thus not visible to a viewer. The suspension ring assembly is made up of a suspension ring; a ring cavity integrally formed in the frame member and outwardly opening, the cavity sized to hold the suspension ring in its entirety to enable retraction of the suspension ring therein; and, a dowel inserted into the cavity and positioned perpendicularly to the plane of the suspension ring and inserted through the ring so as to secure the ring to the frame member when the ring is retracted into the cavity and when the ring is extended when in use.

In another version, the frame member is made of two parts to form the front side and the back side, namely a front frame member and a back frame member, the window section of each holding a transparent cover, the front and back frame members being hingeably connected one to the other to enable the front and back members to pivot apart from one another in an open position to permit removal and replacement of the display item(s), and to pivot toward one another in a closed position to secure the display item(s) in place for viewing from either side. The ring cavity is integrally formed by a pair of symmetrical cutouts oppositely positioned in the front and back frame members so as to form a closed cavity when the frame members are in the closed position.

In another version, a method is provided having steps for using one or more of the devices described above.

Several objects and advantages of the present invention are:

a) suspension means by which a reversible display frame may be rotatably mounted on a wall;

b) means by which the suspension means may be rotated while preserving its original appearance;

c) means by which a reversible display frame with two sides may be mounted to a suspension device to preserve its original appearance regardless of side displayed; and, d) means by which a suspension device may be attached to a reversible display frame to enable orientation in either a vertical or horizontal plane without said means being visible when not in use.

Whereby a display frame combination is provided to enable a user to easily reverse the side of the frame displayed while maintaining the appearance of both the suspension device from which the display frame is suspended from a wall and the display frame itself The reader is advised that this summary is not meant to be exhaustive. Further features, aspects, and advantages of the present invention will become better understood with reference to the following description, accompanying drawings and appended claims.

BRIEF DESCRIPTION OF DRAWINGS

For a better understanding of the present invention, reference may be made to the accompanying drawings, in which:

FIG. 5*a*, shows a close-up view of one version of the suspension ring assembly employing a flat plate;

FIG. 5*b*, shows a close-up view of the suspension ring assembly of FIG. 5*a* with the plate removed to show the ring and dowel detail;

FIG. 5*c*, shows a side view of the suspension ring assembly of FIG. 5*a* when the front and back frame members are in the closed position;

FIG. 5*d*, shows one alternative version of the plate;

FIG. 5*e*, shows a side view of the suspension ring assembly employing the alternative plate of FIG. 5*d* when the front and back frame members are in the closed position; and, FIG. 6, depicts a user rotating the display frame and suspension device while mounted on a wall to view a display item located on the opposite side.

Figure 1:
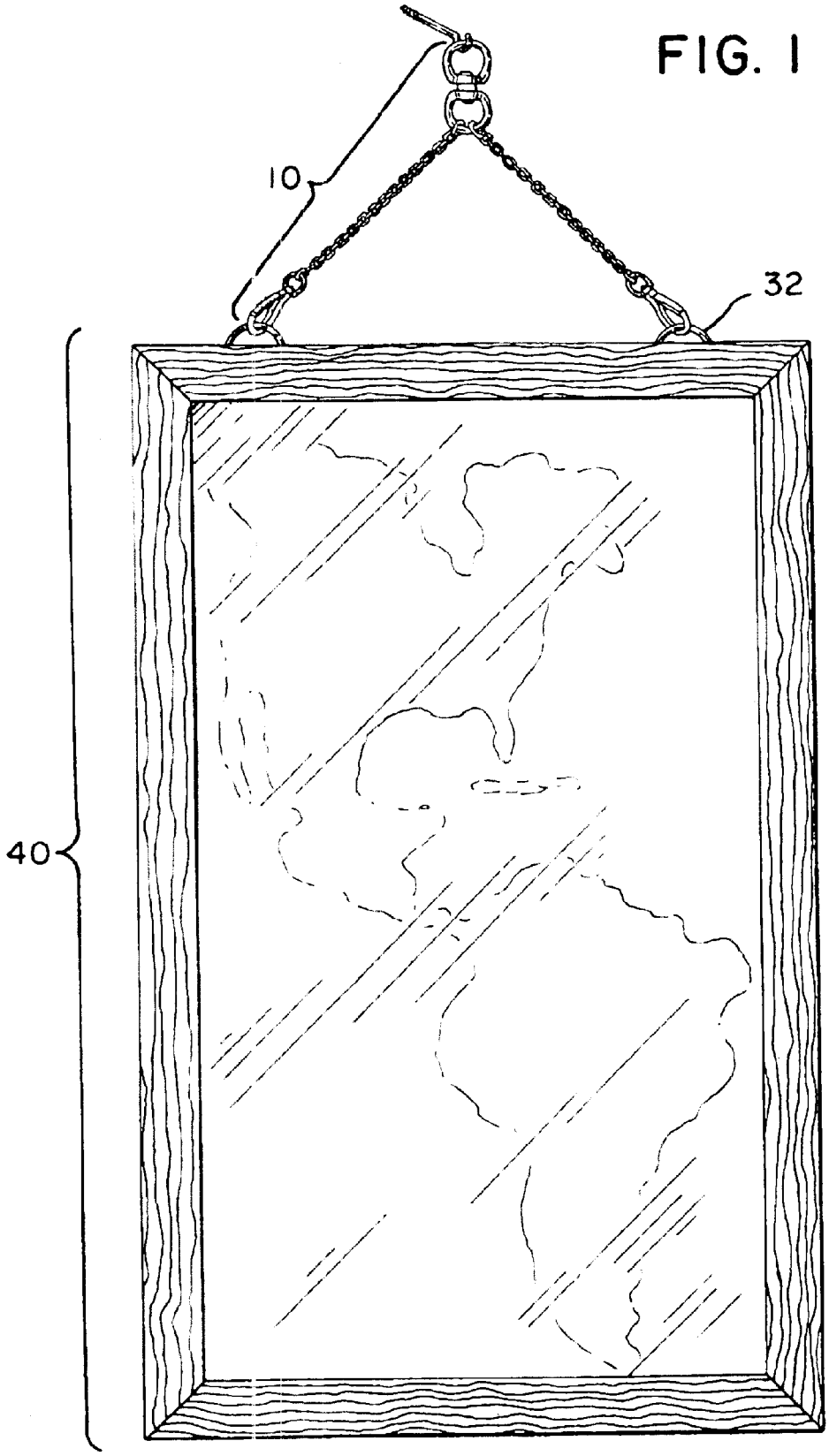
FIG. 1, shows one version of the combination suspension device and reversible display frame.

| Reference Numerals In Drawings: |
|---|
| 10 suspension device |
| 12 wall assembly |
| 13 upper loop member of assembly 12 |
| 14 lower loop member of assembly 12 |
| 15 fastener of suspension device 10 |
| 16 upper member of fastener 15 |
| 17 lower member of fastener 15 |
| 18 line of suspension device 10 |
| 19 link |
| 30 suspension ring assembly |
| 31 cutout in back frame member 45 |
| 32 suspension ring |
| 34 plate of ring assembly 30 |
| 35 plate screw or bolt of assembly 30 |
| 36 dowel of ring assembly 30 |
| 37 plate spacer of assembly 30 |
| 38 cutout in front frame member 44 |
| 40 reversible display frame |
| 42 transparent cover of frame 40 |
| 44 front frame member of frame 40 |
| 45 back frame member of frame 40 |
| 46 closure device of frame 40 |
| 48 hinge of frame 40 |
| 50 wall hook of frame 40 |

DESCRIPTION

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims. In the description below, applicant intends to encompass within the language any structure presently existing or developed in the future that performs the same function.

Detailed Description

An apparatus as shown in FIG. 1, a display frame combination, comprises a suspension device 10 for rotatably suspending a reversible display frame 40 by its at least one suspension ring 32, thus enabling a user to reverse the display frame while it is mounted on a wall (or other surface) to selectively show the display items contained therein from either side and without marring the appearance of either the frame 40 or the suspension device 10.

Figure 2:
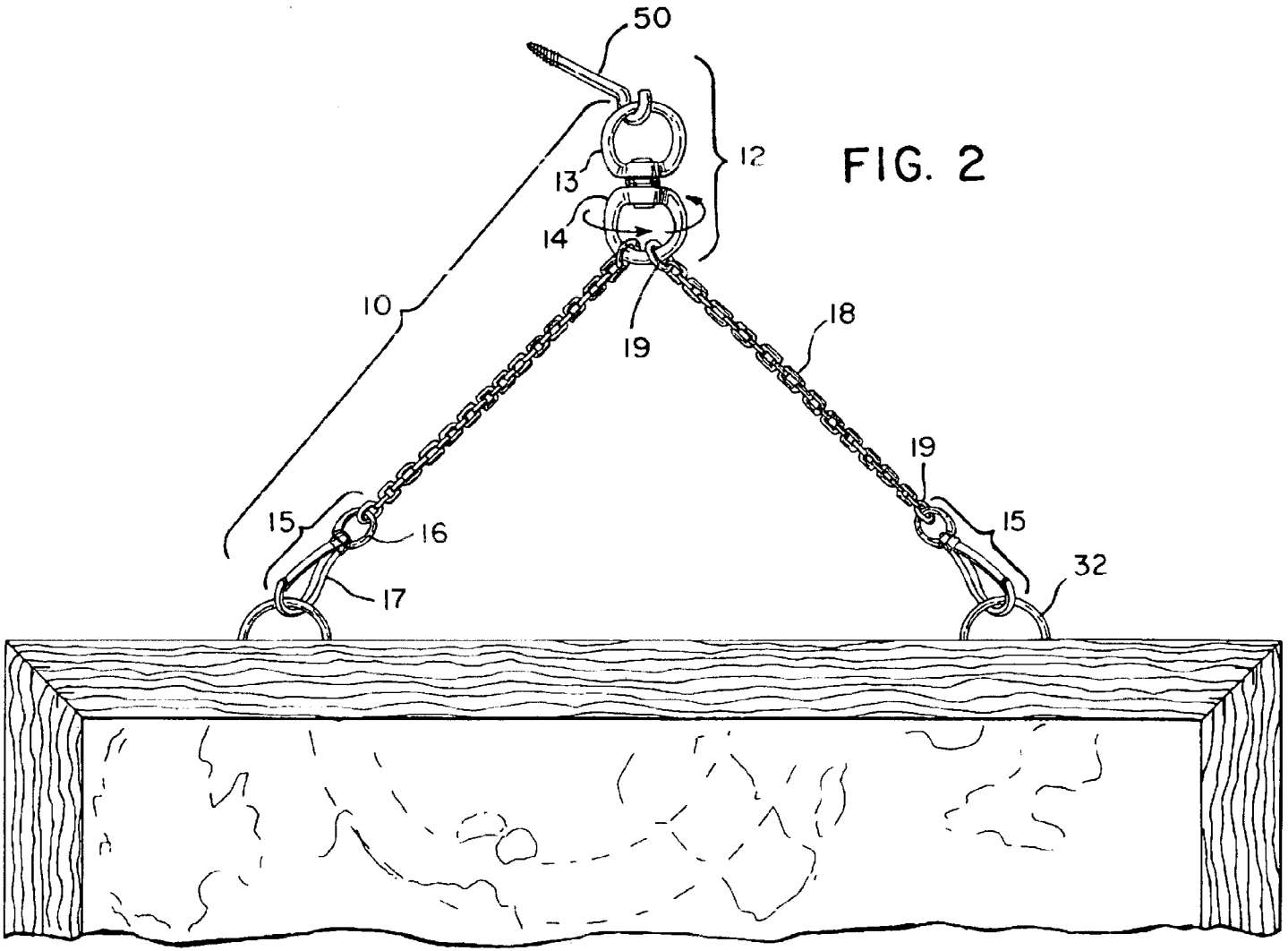
FIG. 2, shows a detail view of one version of the suspension device in which the line is comprised of a chain material.
Figure 3:
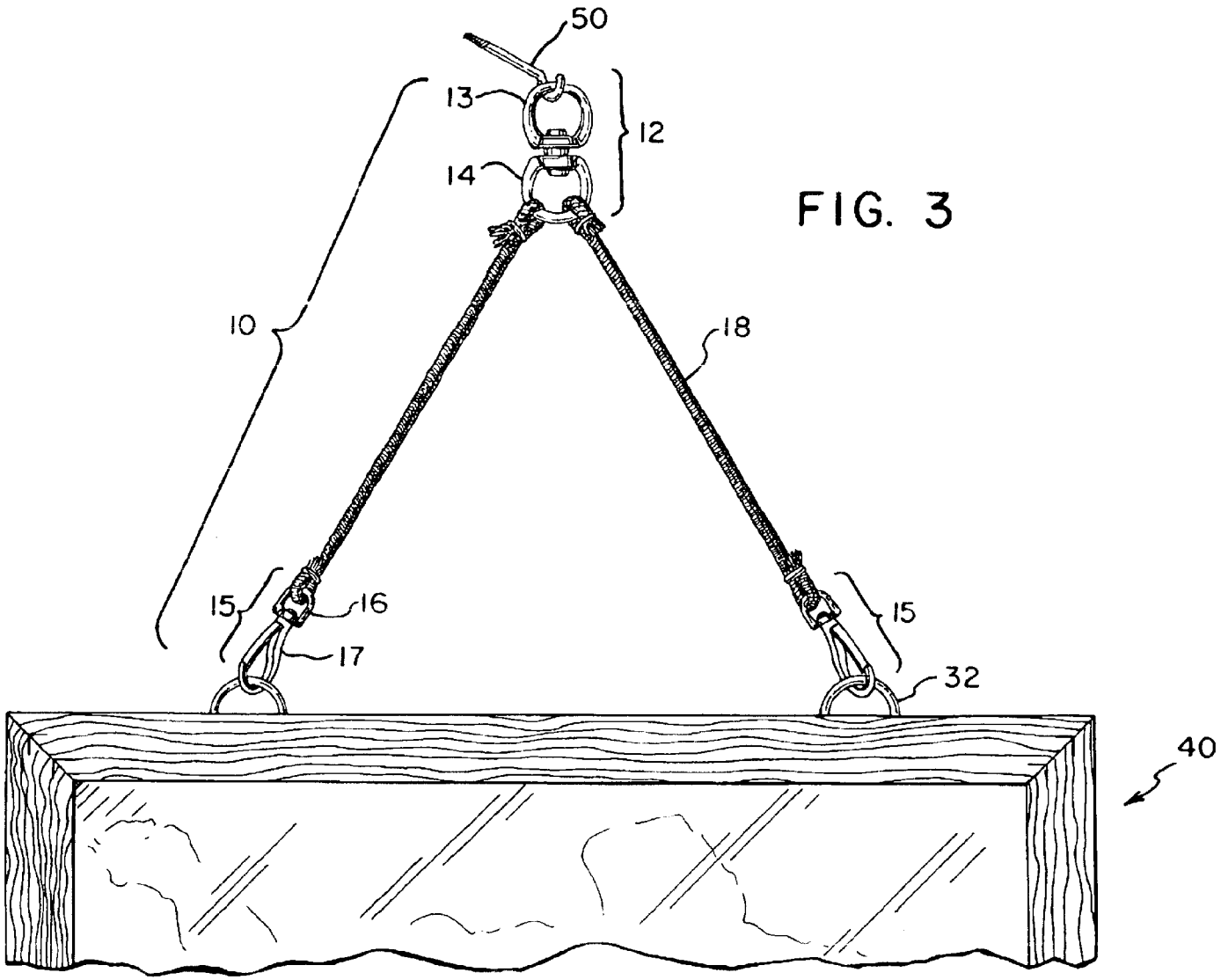
FIG. 3, shows a detail view of one version of the suspension device in which the line is comprised of a chord material.

Referring to FIGS. 2 and 3, the suspension device 10 is employed to rotatably mount the reversible display frame 40 to a wall. The suspension device 10 is comprised of a wall assembly 12, an at least one fastener 15 and an at least one line 18 connecting the wall assembly 12 and at least one fastener 15.

Note that, as depicted in FIGS. 1—3, the display frame 40 has two suspension rings 32, and therefore, the suspension device 20 likewise has two lines 18 and two fasteners 15. The suspension device 10 may employ one, two or more lines 18 and fasteners 15 depending on the number of suspension rings 32 on the frame 40. The number of suspension rings 32 employed on a given frame 40 may vary according to the size and shape of the frame 40 or for other reasons. The suspension device 10 may likewise vary to accommodate the configuration of the particular frame 40 being suspended.

The wall assembly 12 functions to attach the suspension device 10 to a wall and to enable the suspension device 10 and reversible display frame 40 to be simultaneously rotated together by a user on their axes so as to display items contained therein from the other side. The wall assembly 12 comprises an upper loop member 13 and a lower loop member 14 pivotally coupled one to the other. The pivotal coupling of loop members 13 and 14 enables the rotation of the suspension device 10 while mounted on a wall without twisting the lines 18 (when two or more lines 18 are employed) or otherwise marring the appearance of the suspension device 10 in any way. A user is thus able to rotate the suspension device 10 while it and the reversible display frame 40 are mounted on a wall, without changing the appearance of the display frame suspension device combination in the least. This enables users to quickly and easily display the display items from either side without changing the overall appearance of the frame 40 and suspension device 10.

The fasteners 15 serve to engageably attach the suspension device 10 to one or more suspension rings 32 on the reversible display frame 40. The fasteners 15 may be comprised of simple clasp devices (or the like) alone or, as illustrated in FIGS. 2 and 3, the fasteners 15 may comprise an upper member 16 and a lower member 17. When comprised of two parts as illustrated, the upper member 16 is a loop at which the line 18 is attached and the lower member 17 is an engagement means (i.e., clasp or the like) to enable the fastener 15 to fasten to the suspension ring 32. The upper member 16 and lower member 17 may be pivotally coupled one to the other.

The one or more lines 18 each have an upper end and a lower end, the upper end being connected to the lower loop member 14 of the wall assembly, the lower end being connected to a fastener 15. The lines 18 may be made of many different materials to match the materials of the display frame 40 or the decor of the user. For example, the lines 18 in FIG. 2 are illustrated as comprising chains, and in this particular illustration, the chains have links 19 at each end to attach more securely to the lower loop member 14 of the wall assembly 12 and to the fastener 15. In FIG. 3, the lines 18 are illustrated as comprising decorative cording, the ends of which are wrapped around the lower loop member 14 and fastener 15. Any number of materials and colors thereof may be employed as lines 18 to provide varying levels of strength to support reversible display frames 40 of varying sizes, and to provide varying types of looks to match design elements of the frames 40 and the decor of the users. For example, chains in wood, gold, silver, bronze, steel or other materials and chords of silk, nylon, cotton or other materials may be employed. Cylinders of wood, plastic, metal or other materials may be inserted over the lines 18 to further embellish the suspension device 10 to accentuate the features of the particular frame and/or decor of the user.

Likewise, the wall assembly 12 and fasteners IS may be made of a variety of materials such as brass, steel, aluminum and wood, and in various sizes and colors to accommodate the design preferences of users.

Figure 4:
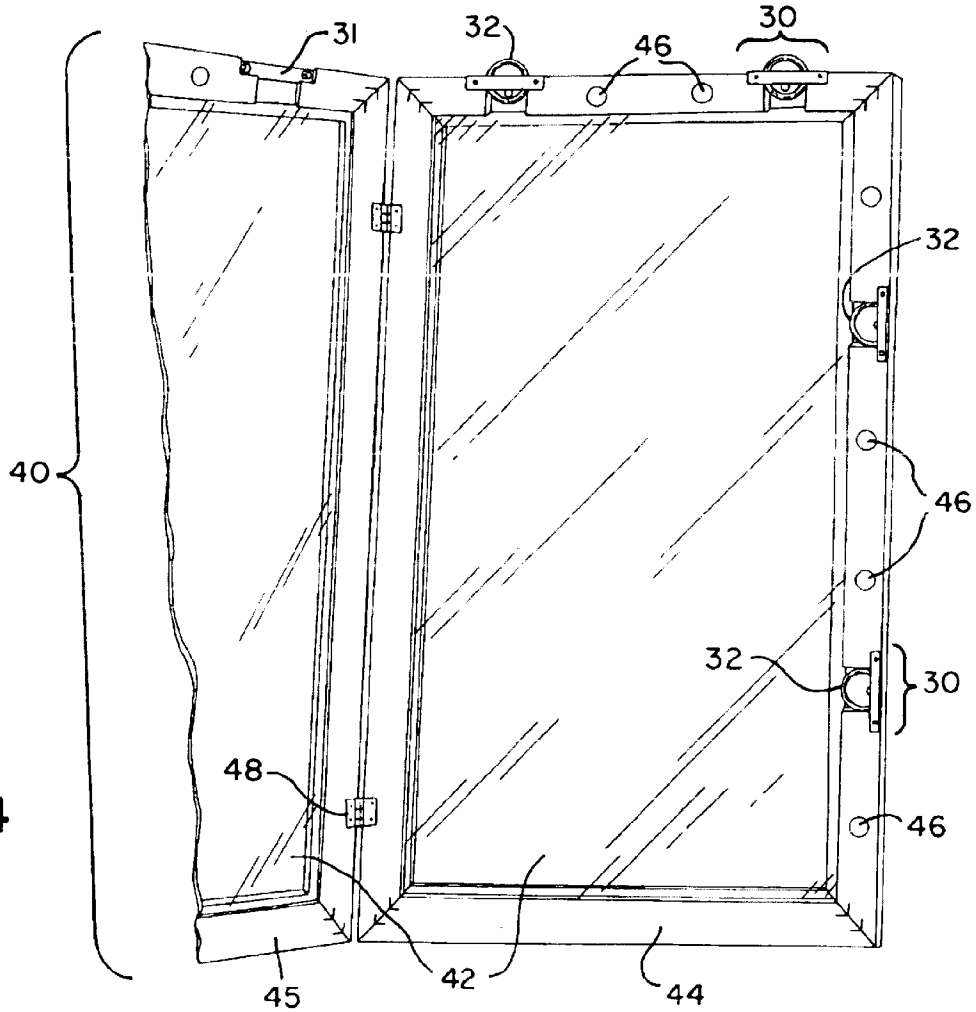
FIG. 4, shows one version of the display frame in which the frame member is comprised of two parts and in which the two parts are in an open position.

Referring to FIGS. 1 and 4, the reversible display frame 40 comprises generally a frame member having a front side and a back side, the front and back sides each having a window section for viewing one or more display items contained therein from either side of the frame member. The frame member may be oval, square, rectangular or other shapes.

In one version, the frame member may be comprised of a single piece with window sections formed in the front and back of it and with an insertion slot or other mechanism for inserting display items into a hollow interior portion therein. In another version as illustrated in FIG. 4, the frame member may be comprised of two parts to form the front side and the back side, namely a front frame member 44 and a back frame member 45, the window section of each member holding a transparent cover 42, the front and back frame members (44, 45) being hingeably connected one to the other by hinges 48 to enable the front and back members (44, 45) to pivot apart from one another in an open position to permit removal and replacement of the display item(s), and to pivot toward one another in a closed position to secure the display item(s) in place for viewing from either side. The front and back members (44, 45) may be secured in the closed position by a variety of types of closing mechanisms 46 such as magnets, bolts, clasps or the like. Closing mechanisms 46 such as magnets (as illustrated in FIG. 4) have the advantage of not being visible from the exterior of the frame members (44, 45) and thus not marring their exterior appearance. They also enable easy opening and closing of the frame members (44, 45).

Various types of display items may be displayed including papers, artwork, collectibles, photos, posters and the like. The reversible display frame 40 enables a user to display both sides of a double-sided display item or single sides of two or more separate items.

The display frame 40 also comprises at least one suspension ring 32 attached to the frame member. As illustrated in FIGS. 4, 5*a,b,c* and *e*, two suspension rings 32 are attached to the front frame member 44. As discussed above, the suspension device 10 is attached to the reversible display frame 40 by attachment via one or more fasteners 15 to the suspension rings 32. Two sets of two suspension rings 32 may be attached to the front frame member 44 to enable display of a rectangularly shaped display frame 40 in a vertical or horizontal orientation. The rings 32 may be made of a variety of materials to match the design of the frame 40 and suspension device 10.

In one embodiment, the display frame 40 may further comprise one or more suspension ring assemblies 30. A suspension ring assembly 30 comprises one of the suspension rings 32, a ring cavity integrally formed in the frame member and outwardly opening (one embodiment is illustrated in FIGS. 4 and 5*c* and e, at 38, 31), the cavity sized to hold the suspension ring in its entirety to enable retraction of the suspension ring therein when not in use, and, a dowel 36 inserted into the cavity and secured thereto, the dowel positioned perpendicularly to the plane of the suspension ring and inserted through the ring so as to secure the ring to the frame member when the ring is retracted into the cavity and when the ring is extended therefrom. The suspension ring assembly 30, thus enables the retraction of suspension rings 32 when not in use so they are not visible when the display frame 40 is mounted. This is particularly useful in the embodiment of the frame 40 where suspension rings 32 are included to enable mounting in either a vertical or horizontal orientation, where only one set of rings 32 is in use at any one time. The rings 32 not in use may be retracted so as to be invisible to a viewer.

In one embodiment, the ring cavity (38, 31 combined) is integrally formed by a pair of symmetrical cutouts oppositely positioned in the front and back frame members (44, 45) so as to form a cavity with an opening to the exterior of the frame 40 when the frame members (44, 45) are in the closed position (see FIGS. 4, 5*a–e*). The ring 32 is held in place by the dowel 36 located in the cutout 38 in the front frame member 44 as discussed above. When the front and back frame members (44, 45) are in the closed position, the opposite cutout 31 in the back frame member 45 is positioned over the dowel 36 to hold the ring 32 in place during retraction and extension.

However, the ring 32 may optionally be held in place even more securely by employing a plate 34 secured over the dowel 36 by screws or bolts 35 in the front frame member 44. When the plate 35 is a straight plate as illustrated in FIGS. 5*a, c*, spacers 37 may be employed to hold the plate 34 to the height of the dowel 36. Alternative plate configurations may be employed, such as a plate with bends at each end as illustrated in FIGS. 5*d* and *e*. In that case no spacers 37 are needed as the bends are of an appropriate height for the dowel 36.

How the invention is used

Figure 6:
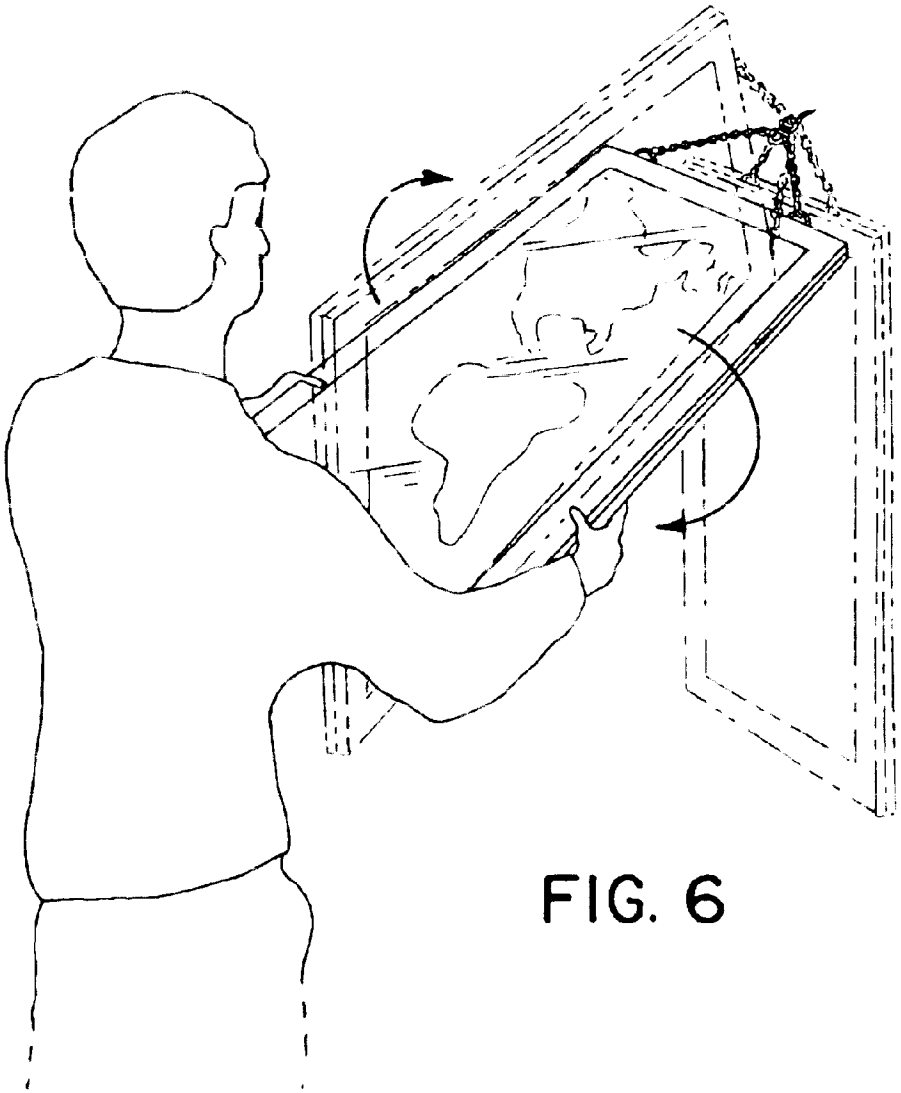

The method of using the display frame combination is simple and elegant and illustrated generally in FIG. 6. Providing the suspension device 10 and reversible display frame 40 as described above, a user may remove and insert display items as desired and according to the construct of the particular display frame 40 employed. In the case of a frame member in two parts (44, 45), the members are placed in the open position when the user is inserting or removing display items and the members are placed in the closed position when the user is ready to suspend the frame 40 using the suspension device 10.

The user attaches the suspension device 10 to the one or more suspension rings 32 by means of the fasteners 15. The suspension device 10 in combination with the frame 40 may then be mounted on a wall by insertion of the upper loop member 13 of the wall assembly 12 onto a wall hook 50.

A user may reverse the side of the display frame 40 displayed by lifting a lower portion of the display frame 40 away from the wall, rotating the display frame 40 and attached suspension device 10 by means of the pivotal coupling of the wall assembly 12, and setting the frame 40 back on the wall. The other side of the display frame 40 is thus exposed and the suspension device 10 rotated such that the lines 18 remain untwisted and clean in appearance.

Advantages of the invention

The previously described versions of the present invention have many advantages, including:

a) suspension means (i.e. suspension device 10) by which a reversible display frame may be rotatably mounted on a wall;

b) means by which the suspension means may be rotated while preserving its original appearance (i.e. the rotatably coupled upper and lower members (13, 14) of the wall assembly 12);

c) means by which a reversible display frame with two sides may be mounted to a suspension device to preserve its original appearance regardless of side displayed; and, d) means by which a suspension device may be attached to a reversible display frame to enable orientation in either a vertical or horizontal plane without said means being visible when not in use (i.e. retractable suspension rings 32 of suspension assembly 30).

The present invention does not require that all the advantageous features and all the advantages need to be incorporated into every embodiment thereof.

Closing

Although the present invention has been described in considerable detail with reference to certain preferred versions thereof, other versions are possible. Therefore, the spirit and scope of the appended claims should not be limited to the description of the preferred versions contained herein.

What is claimed is:

1. A display frame combination comprising:

a reversible display frame comprising:

a frame member having a front side and a back side, the front and back sides each side having a window section for viewing an at least one display item contained therein from either side of the frame member, and wherein the frame member is comprised of two parts to form the front side and the back side, namely a front frame member and a back frame member, a set of two transparent covers being held in the window section of one or both frame members, the front and back frame members being hingeably connected one to the other to enable the front and back members to pivot apart from one another in an open position to permit removal and replacement of the at least one display item, and to pivot toward one another in a closed position to secure the at least one display item in place for viewing from either side; and, an at least one suspension ring attached to said frame member;

a suspension device for rotatably mounting the reversible display frame to a wall, the suspension device comprising:

a wall assembly comprising an upper loop member and a lower loop member pivotally coupled one to the other, said upper loop member being sized to enable insertion on a wall hook;

an at least one fastener for engagable attachment of the suspension device to said at least one suspension ring of the reversible display frame; and, an at least one line having an upper end and a lower end, the upper end being connected to the lower loop member of the wall assembly, the lower end being connected to said at least one fastener; and, an at least one suspension ring assembly, said suspension ring assembly comprising:

one of the at least one suspension rings;

a ring cavity integrally formed in the frame member and outwardly opening, the cavity sized to hold the suspension ring in its entirety to enable retraction of the suspension ring therein, the ring cavity integrally formed by a pair of symmetrical cutouts oppositely positioned in the front and back frame members so as to form a closed cavity when the frame members are placed in the closed position; and, a dowel inserted into the cavity and secured thereto, the dowel positioned perpendicularly to the plane of the suspension ring and inserted through the ring so as to secure the ring to the frame member when the ring is retracted into the cavity and when the ring is extended therefrom, the dowel two ends and positioned within the ring cavity by attachment of one end of the dowel to the cutout in the front frame member, and wherein the suspension ring is held in place by an elongated plate with two ends, the plate being positioned centrally across the other end of the dowel and secured to the front frame member at each of its two ends;

whereby said reversible display frame combination may be pivotably mounted on the wall so as to enable its rotation while mounted to enable a user to selectively show the at least one display item contained therein from either side of the reversible display frame.

2. A method for rotatably displaying a reversible display frame, comprising:

providing a reversible display frame comprising:

a frame member having a front side and a back side, the front and back sides each side having a window section for viewing an at least one display item contained therein from either side of the frame member, and wherein the frame member is comprised of two parts to form the front side and the back side, namely a front frame member and a back frame member, a set of two transparent covers being held in the window section of one or both frame members, the front and back frame members being hingeably connected one to the other to enable the front and back members to pivot apart from one another in an open Position to permit removal and replacement of the at least one display item, and to pivot toward one another in a closed position to secure the at least one display item in place for viewing from either side; and, an at least one suspension ring attached to said frame member;

providing a suspension device for rotatably mounting the reversible display frame to a wall, the suspension device comprising:

a wall assembly comprising an upper loop member and a lower loop member pivotally coupled one to the other, said upper loop member being sized to enable insertion on a wall hook;

an at least one fastener for engagable attachment of the suspension device to one of said at least one suspension rings of the reversible display frame; and, an at least one line having an upper end and a lower end, the upper end being connected to the lower loop member of the wall assembly, the lower end being connected to one of said at least one fasteners;

providing an at least one suspension ring assembly, said suspension ring assembly comprising:

one of the at least one suspension rings;

a ring cavity integrally formed in the frame member and outwardly opening, the cavity sized to hold the suspension ring in its entirety to enable retraction of the suspension ring therein, the ring cavity integrally formed by a pair of symmetrical cutouts oppositely positioned in the front and back frame members so as to form a closed cavity when the frame members are placed in the closed position; and, a dowel inserted into the cavity and secured thereto, the dowel positioned perpendicularly to the plane of the suspension ring and inserted through the ring so as to secure the ring to the frame member when the ring is retracted into the cavity and when the rind is extended therefrom, the dowel two ends and positioned within the ring cavity by attachment of one end of the dowel to the cutout in the front frame member, and wherein the suspension ring is held inplace by an elongated plate with two ends, the plate being positioned centrally across the other end of the dowel and secured to the front frame member at each of its two ends;

attaching the suspension device to the at least one suspension ring of the reversible display frame by means of the at least one fastener;

mounting the display frame and suspension device on a wall by inserting the upper loop member of the wall assembly over the wall hook; and, reversing the side of the frame member displayed by rotating the display frame while simultaneously pivoting the suspension device at the pivotal coupling of the upper and lower loop members of the wall assembly, thereby enabling display of the at least one display item contained therein from the other side of the reversible display frame.

* * * * *

UNITED STATES PATENT AND TRADEMARK OFFICE

CERTIFICATE OF CORRECTION

PATENT NO. : 6,775,939 B1
DATED : October 6, 2004
INVENTOR(S) : Jeremy Scott Juern It is certified that error appears in the above-identified patent and that said Letters Patent is hereby corrected as shown below:

Column 8,
Line 52, should read -- the suspension ring therein, the ring cavity being integrally --; and
Line 62, should read -- extended therefrom, the dowel having two ends and being posi- --.

Column 10,
Line 9, should read -- the suspension ring therein, the ring cavity being integrally --; and
Line 19, should read -- extended therefrom, the dowel having two ends and being posi- --.

Signed and Sealed this

Twenty-first Day of December, 2004

JON W. DUDAS
*Director of the United States Patent and Trademark Office*